US006086360A

United States Patent [19]

McDonough et al.

[11] Patent Number: 6,086,360

[45] Date of Patent: Jul. 11, 2000

[54] UTILITY LIGHTER

[75] Inventors: James M. McDonough, Guilford; Floyd B. Fairbanks, Naugatuck; F. Nicolas Garoffolo, Westport; Chris A. Barone, Trumbull, all of Conn.

[73] Assignee: BIC Corporation, Milford, Conn.

[21] Appl. No.: 08/917,134

[22] Filed: Aug. 25, 1997

Related U.S. Application Data

[63] Continuation-in-part of application No. 08/787,399, Jan. 22, 1997.

[51] Int. Cl.[7] ..... F23Q 7/12

[52] U.S. Cl. ..... 431/255; 431/254; 431/344

[58] Field of Search ..... 431/255, 344, 431/258, 266, 254

[56] References Cited

U.S. PATENT DOCUMENTS

| | | | |
|---|---|---|---|
| D. 345,489 | 3/1994 | Moh | D7/416 |
| 3,520,647 | 7/1970 | Poppel | 431/254 |
| 3,580,698 | 5/1971 | Goto | 431/255 |
| 3,947,731 | 3/1976 | Vainer | 317/81 |
| 4,069,006 | 1/1978 | Jackson | 431/344 |
| 4,253,818 | 3/1981 | Ogawa et al. | 431/142 |
| 4,253,820 | 3/1981 | Jarreau | 431/344 |
| 4,259,059 | 3/1981 | Roosa et al. | 431/254 |
| 4,273,528 | 6/1981 | Göbelt | 431/255 |
| 4,292,021 | 9/1981 | Miyagawa | 431/13 |
| 4,389,187 | 6/1983 | Sims | 431/277 |
| 4,403,946 | 9/1983 | Kagawa | 431/255 |
| 4,462,791 | 7/1984 | Hayden | 431/345 |
| 4,516,933 | 5/1985 | Buzzi | 431/255 |
| 4,538,983 | 9/1985 | Zeller et al. | 431/255 |
| 4,569,654 | 2/1986 | Borghesi | 431/255 |
| 4,610,624 | 9/1986 | Bruhn | 431/255 |
| 4,635,382 | 1/1987 | Bourdeau | 34/97 |
| 4,691,691 | 9/1987 | Patenaude | 126/414 |
| 4,778,380 | 10/1988 | Nitta | 431/255 |
| 4,854,859 | 8/1989 | Lin | 431/344 |
| 4,919,111 | 4/1990 | Ohsawa | 126/25 B |
| 5,059,852 | 10/1991 | Meury | 310/339 |
| 5,135,388 | 8/1992 | Pettit | 431/254 |
| 5,154,601 | 10/1992 | Capilla | 431/255 |
| 5,222,889 | 6/1993 | Hsu | 431/255 |
| 5,262,697 | 11/1993 | Meury | 310/339 |
| 5,284,439 | 2/1994 | Shike et al. | 431/263 |
| 5,322,433 | 6/1994 | Shike et al. | 431/266 |
| 5,326,256 | 7/1994 | Shike et al. | 431/255 |
| 5,545,035 | 8/1996 | Tsai | 431/255 |
| 5,616,022 | 4/1997 | Moran, IV | 431/253 |
| 5,697,775 | 12/1997 | Saito et al. | 431/153 |
| 5,738,507 | 4/1998 | Mifune et al. | 431/344 |

FOREIGN PATENT DOCUMENTS

| | | |
|---|---|---|
| 2036387 | 5/1995 | Russian Federation . |

*Primary Examiner*—Larry Jones

*Attorney, Agent, or Firm*—Pennie & Edmonds LLP

[57] ABSTRACT

The present invention relates to a utility lighter including a housing having a handle at one end and a nozzle at another end and including a fuel supply connected for selective fluid communication with the nozzle. An ignitor assembly, such as a piezoelectric mechanism, is operatively connected to the housing for generating a spark proximate the nozzle and an actuating assembly is connected to the housing proximate the handle and operates to both dispense fuel from the fuel supply and to activate the ignitor assembly. A linking mechanism is provided in order to initiate the flow of fuel from the fuel supply prior to generation of a spark such that a spark is generated when fuel is present at the nozzle. A locating mechanism is provided proximate the valve of the fuel container in order to properly position the fuel container within the housing. In addition, an isolator cap is disposed around the nozzle to assist in directing the spark in the vicinity of the nozzle.

30 Claims, 10 Drawing Sheets

UTILITY LIGHTER

CROSS-REFERENCE TO RELATED APPLICATIONS

This is a continuation-in-part of Application No. 08/787,399, filed Jan. 22, 1997.

TECHNICAL FIELD

The present invention generally relates to general purpose utility lighters such as those used to ignite candles, barbecue grills, fireplaces and campfires.

BACKGROUND OF THE INVENTION

Lighters such as those used for igniting tobacco products, such as cigars, cigarettes, and pipes, have developed over a number of years. Typically, these lighters use either a rotary friction element or a piezoelectric element to generate a spark in proximity to a nozzle emitting fuel from a fuel container. Piezoelectric mechanisms have gained universal acceptance because they are simple to use. One such piezoelectric mechanism is disclosed in U.S. Pat. No. 5,262,697 ("the '697 patent"). The disclosure of the '697 patent is incorporated by reference herein.

Lighters have also evolved from the small, hand-held lighters to several forms of extended lighters. These lighters are also hand held, but are more useful for general purposes such as lighting candles, barbecue grills, fireplaces and campfires. Earlier attempts at such designs relied simply on extended actuating handles to house a typical lighter at the end. Examples of this concept are found in U.S. Pat. Nos. 4,259,059 and 4,462,791.

In addition, many general purpose lighters have had some form of operating mechanism for resisting undesired operation of the lighter by young children. Often, these mechanisms take the form of on/off switches that may shut off the fuel source or may completely prevent movement of an actuator, such as a push-button, on the lighter. While it is desirable to inhibit certain operation of lighters, such as use by children, it is also desirable to maintain good function.

Moreover, the use of on/off switches that must be positively moved by the user between "on" and "off" positions has drawbacks. For example, an adult user may forget to move the switch back to the "off" position after use and thereby render the feature ineffective.

Further problems are specific to lighters incorporating piezoelectric mechanisms. In particular, to use these mechanisms in extended length lighter devices, wires have normally been required to connect the piezoelectric mechanism to the forward end of the lighter proximate the fuel nozzle. One prior concept that eliminates the wires typically associated with a piezoelectric mechanism is U.S. Pat. No. 5,154,601. This lighter places the piezoelectric element proximate the forward end of the lighter with one end of the piezoelectric element in direct contact with the burner or nozzle, while the opposite end is in contact with a tube forming part of a push button assembly. The push button assembly is electrically conductive and, during actuation, slides against a metal housing portion. While this construction does eliminate the use of wires, the design also requires contact between a moving push button and a housing portion to complete the electrical circuit. This contact not only relies on close tolerances during manufacture but, over time, the push button may lose electrical contact with the metal housing portion. This is especially true if wear creates a gap between the push button and the metal housing portion.

Moreover, the design requires that the user move the push button in a forward direction rather than a more ergonomic and easily accomplished rearward direction of a trigger or inward direction of a push button.

Controlling the electrically generated spark is another problem which is specific to piezoelectric mechanisms. In order to ignite the fuel exiting from the nozzle, it is necessary that the spark be created in the vicinity of the fuel. It is, therefore, desirable to provide a utility lighter which reliably produces a spark at a precise location near the nozzle in order to effectively ignite the fuel exiting from the nozzle.

Another factor requiring consideration in the design of utility lighters is the spacing between the fuel supply and the exit nozzle. Since fuel containers are typically located in the handle of the lighter and the nozzle is located at the end of a wand, the fuel from the fuel container is required to reach the nozzle via a conduit. Once the fuel is released from the fuel container by depressing an actuator and opening a valve, the fuel travels down the fuel conduit and ultimately exits through the nozzle. It is desirable to time the arrival of the spark such that fuel is present at the nozzle exit when the spark is created in order to consistently and reliably ignite the lighter. In addition, manufacturing tolerances play a role in when the fuel reaches the nozzle and when the spark is generated. Thus, it is also desirable to minimize the effects of manufacturing tolerances.

Thus, there remains a need for a utility lighter which resists unwanted actuation, minimizes wiring, ignites efficiently and reliably, and minimizes the impact of manufacturing variances.

SUMMARY OF THE INVENTION

These objects and advantages as well as other objects and advantages are accomplished in a utility lighter generally including a housing having a handle proximate a first end and a nozzle with an outlet proximate a second end. The housing further includes a fuel supply connected for selective fluid communication with the nozzle. A valve actuator is associated with the fuel supply for selectively releasing fuel from the fuel supply. An ignitor assembly is operatively connected to the housing for generating a spark at the nozzle outlet. An actuating assembly is connected to the housing proximate the handle and is associated with the valve actuator to both dispense fuel from the fuel supply and to activate the ignitor assembly. In accordance with one aspect of this invention, a linking mechanism is positioned between the actuating assembly and the valve actuator for linking the trigger and the valve actuator to provide controlled release of fuel from the fuel supply prior to the generation of a spark by the ignitor assembly.

The utility lighter may include a latch member, which is operatively connected with the handle and includes a blocking portion connected for biased movement relative to the actuating assembly. This blocking portion is normally biased into engagement with the actuating assembly to prevent operative movement thereof. Thus, a user may selectively bias the blocking portion out of engagement with the actuating assembly to permit operation of the actuating assembly, such as through the use of a trigger extending from the handle.

The actuating assembly includes a trigger extending from the handle. The trigger is movable to activate the valve actuator and the ignitor assembly. A biased pivoting member may be associated with the trigger and the ignitor assembly for activating the ignitor assembly. The biased pivoting member may also activate the valve actuator. The linking mechanism is preferably operatively associated with the biased pivoting member or the trigger such that when the trigger is moved toward the first end of the housing, the linking mechanism substantially immediately operates on the valve actuator to release fuel from the fuel supply.

The linking mechanism may be a spring, such as a compression, torsion, or leaf spring, positioned between the biased pivoting member and the valve actuator. Alternatively, the spring may be positioned between the trigger and the valve actuator. The linking mechanism may also be integral with the trigger or biased pivoting member.

The fuel supply container is preferably a conventional container of fuel, such as pressurized butane, having a valve for dispensing the fuel to the nozzle and a valve actuator which may be actuated directly or indirectly by the trigger. A conventional conduit, such as plastic tubing may be used to connect the fuel supply container to the nozzle. The biased pivoting member may be mounted between the trigger and a linking rod. The biased pivoting member may also be used to move the valve actuator to open the valve. The linking rod is operatively connected to the ignitor assembly. A preferred ignitor assembly is a piezoelectric mechanism. Other mechanical or electrical ignitor assemblies may be substituted while still realizing one or more advantages of the invention. In a preferred embodiment, the linking rod moves in a direction operable to compress the piezoelectric mechanism which then generates a voltage between a pair of contacts thereof.

In another aspect of this invention, a portion of the lighter housing is formed of an electrically conductive material and is disposed generally between the first and second ends. The second end of the housing includes first and second electrodes electrically connected to the electric ignitor assembly, e.g., the piezoelectric mechanism. As with the first embodiment, a fuel supply container is connected for selective fluid communication with the nozzle. The electric ignitor assembly is operatively connected to the housing for generating a spark in the spark gap, and includes first and second electrical contacts. The first electrical contact is in contact with the electrically conductive housing and the first contact, while the second contact is electrically connected to the second electrode.

The nozzle preferably forms the second electrode, and the electrically conductive housing portion preferably includes an upstanding tab, antenna-like structure, or the like, extending toward the outlet of the nozzle to form the first electrode. A wire leads from the second electrical contact of the electric ignitor assembly to the nozzle. The nozzle is preferably formed of an electrically conductive material, such as metal, and therefore acts as the second electrode. Thus, a spark gap is created between the tab of the conductive housing portion and the nozzle.

As stated above, the ignitor assembly is preferably a piezoelectric mechanism constructed according to the '697 patent. Such a piezoelectric mechanism may be advantageously situated in front of the handle with an electrical contact at a forward end thereof abutting against the electrically conductive housing portion away from the tab portion. The electrically conductive housing portion preferably comprises a metal shell extending forwardly from the piezoelectric mechanism to the second end of the housing. An electrically insulating cap may be disposed around at least a portion of the nozzle for preventing undesired sparks between the nozzle and the electrically conductive housing portion away from the tab portion, which aligns with the forward end of the nozzle. Alternatively, the piezoelectric mechanism may be situated at other locations within the handle, such as adjacent the trigger.

An isolator cap may be disposed around at least a portion of the nozzle for directing sparks between the housing and the nozzle. The isolator cap is non-electrically conducting and may be disposed inside of the electrically conductive housing portion. A longitudinal channel extends through the isolator cap and the nozzle is positioned within the channel. The isolator cap may include a plurality of legs with a gap formed between each leg. The nozzle is located between the legs. Four such legs may be provided and the tab on the housing may extend between two of the legs toward the nozzle to define the spark gap.

In another aspect of this invention, the fuel supply container may be inserted into the handle during manufacture or during replacement by a user, and an inner surface of the handle may include a locating mechanism which facilitates correct placement of the distal end of the container such that the valve of the fuel container is joined with or positioned next to a valve connector associated with the fuel conduit. The locating mechanism positively locates the distal end of the container at a point which is about transversely aligned with the valve connector.

The locating mechanism may include at least one protrusion and the container may include at least one recess for mating with the protrusion in order to positively position the container in the handle.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION

Figure 1:
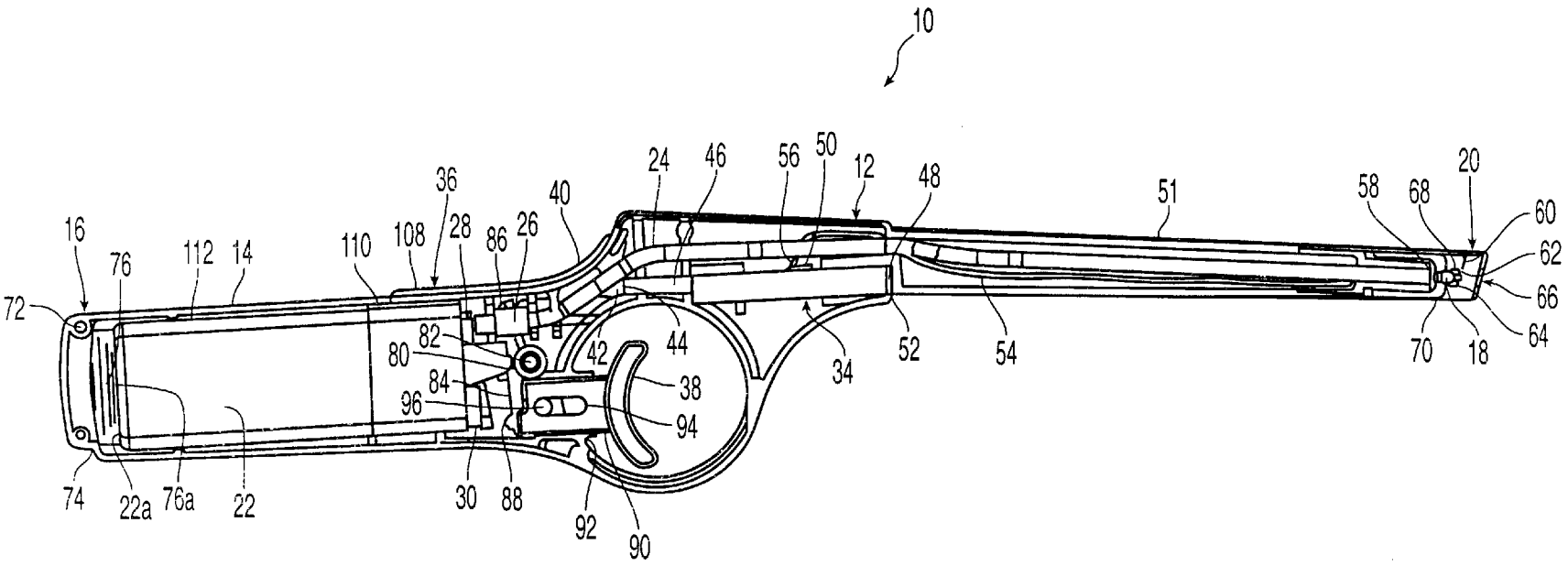
FIG. 1 is a side elevational view of the utility lighter of this invention opened up and with portions in cross-section to show various inner elements thereof.

Turning to FIG. 1, a preferred embodiment of a utility lighter 10 constructed in accordance with the present invention is shown with the understanding that those of ordinary skill in the art will recognize many modifications and substitutions which may be made to various elements.

Lighter 10 generally includes a housing 12 which may primarily be formed of a molded rigid polymer or plastic materials such as acrylonitrile, butadiene, styrene terpolymer, or the like. Housing 12 includes a handle 14 proximate to a first end 16. A nozzle 18 is disposed at a second end 20 for emitting fuel to feed a flame as will be described herein. Handle 14 preferably contains a fuel supply container 22, which may be a conventional butane fuel cell. A conduit 24, such as a plastic tube, is fixed to a fluid connector 26 and then positioned next or connected to a valve 28 on fuel supply container 22. The opposite end of tube 24 connects with nozzle 18.

Valve 28 is operated by a valve actuator 30, which is pivotally attached to fuel supply container 22. Thus, when valve actuator 30 is depressed, e.g., moved toward end 16, fuel is released by valve 28, flows through connector 26 and tube 24, and finally flows to nozzle 18. A suitable fuel supply container 22 is disclosed in U.S. Pat. No. 5,520,197 ("the '197 patent"). The disclosure of the '197 patent is incorporated herein by reference in its entirety.

An actuating assembly is provided to facilitate depression of the valve actuator and to simultaneously activate an ignitor assembly 34 for generating a spark proximate nozzle 18. The actuating assembly preferably comprises a trigger member 38, a biased pivoting member 80, and a linking rod 46 operatively connected to the ignitor assembly 34. These components are described in detail below.

Although not necessary for all aspects of this invention, an electric ignitor assembly such as a piezoelectric mechanism is the preferred ignitor assembly 34. More specifically, the preferred piezoelectric mechanism is of the type disclosed in the '697 patent, the disclosure of which has been incorporated herein by reference.

Figure 2:
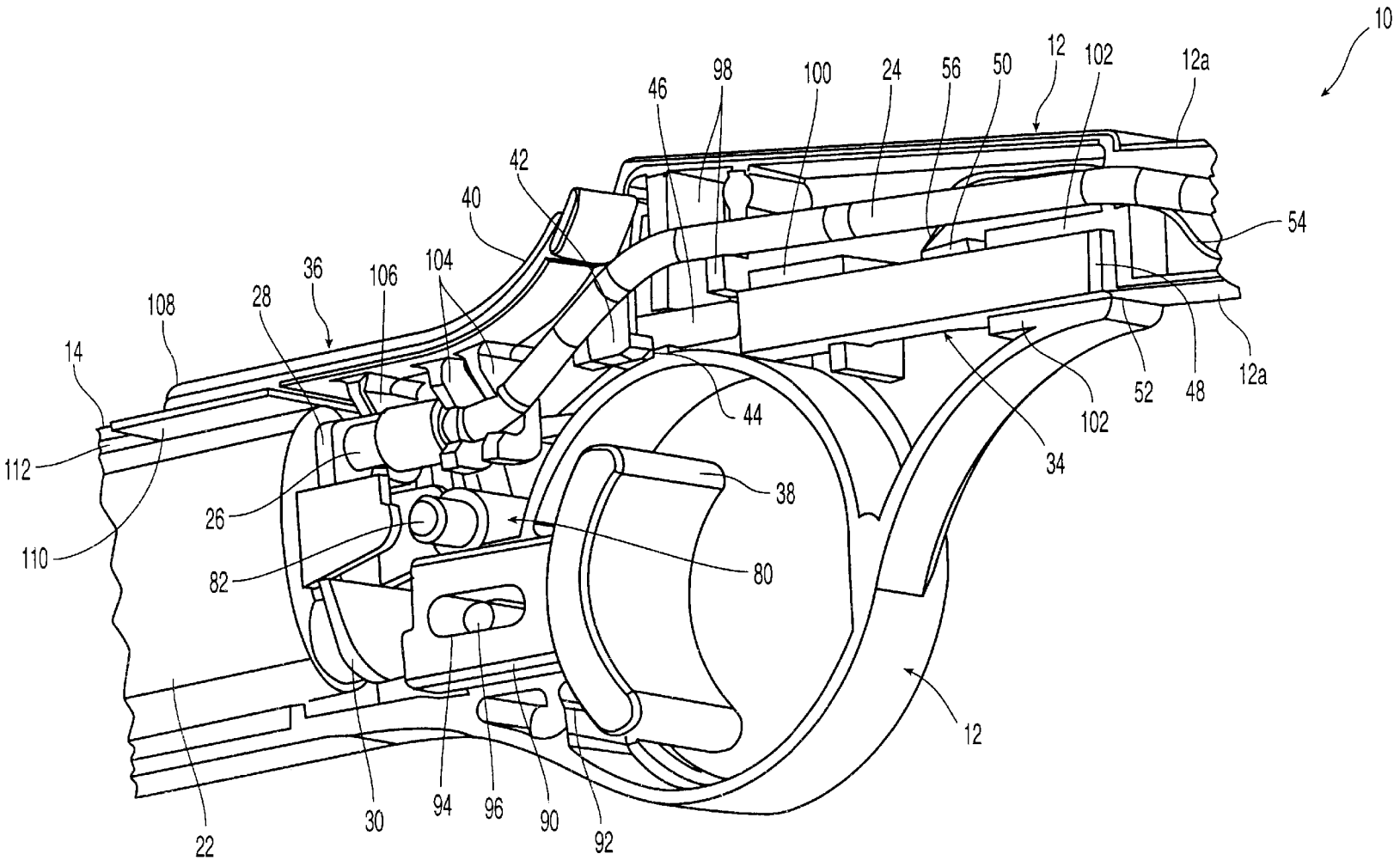
FIG. 2 is an enlarged and partially fragmented perspective view of the lighter shown in FIG. 1 better illustrating various inner details.
Figure 3:
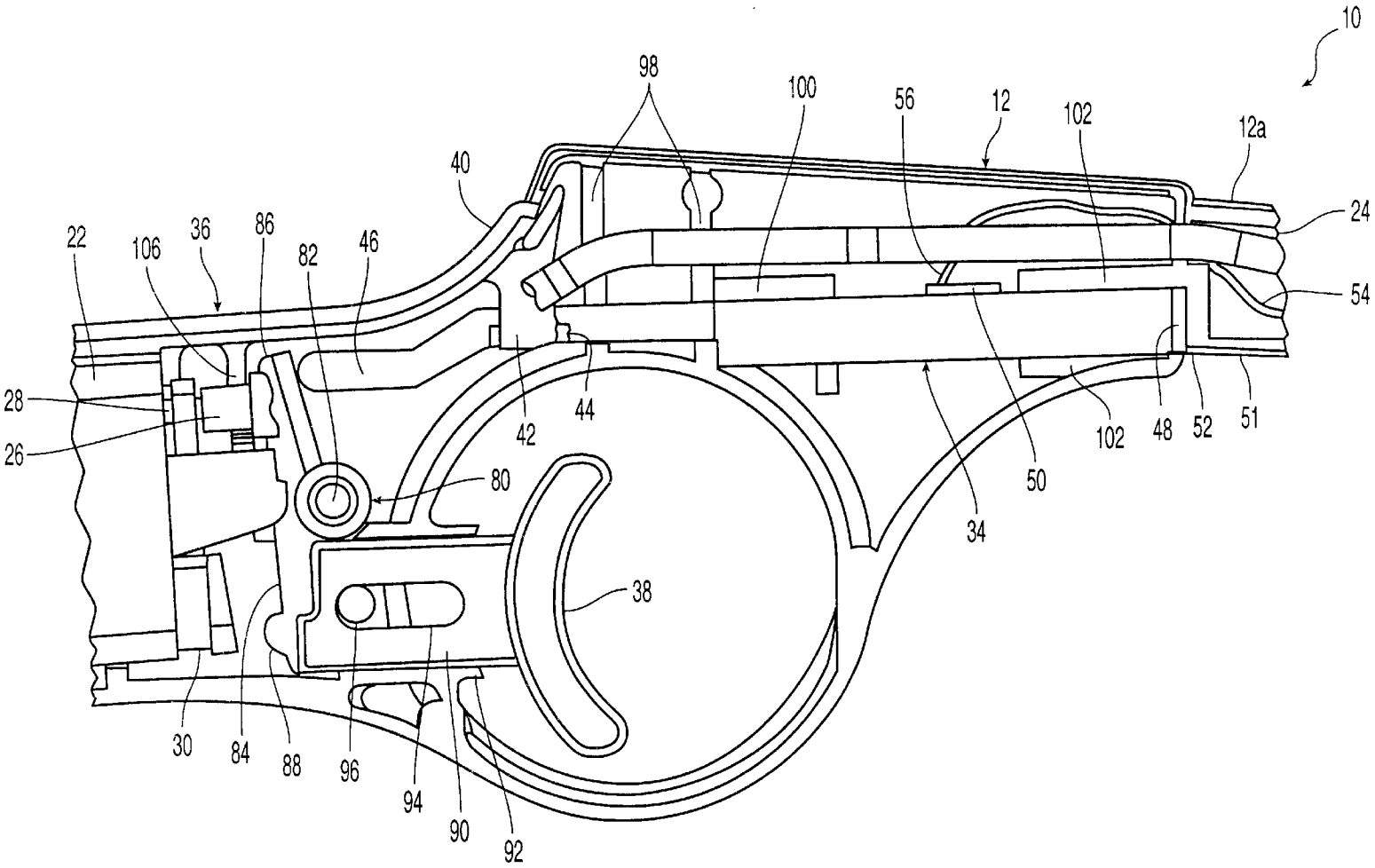
FIG. 3 is an enlarged and partially fragmented side elevational view similar to FIG. 1 but eliminating certain portions to more clearly show the actuating assembly and latch member.

As shown best in FIGS. 2 and 3, a latch member 36 normally locks the actuating assembly in an inoperative position such that a trigger 38 may not be depressed or pulled by a user. As will be discussed further below, latch member 36, as shown in FIGS. 1 and 2, and particularly in FIGS. 3 and 4, generally includes an unsupported resilient front end 40 having an attached hooked tab 42 normally in engagement with stop member structure 44 on a linking rod 46, shown particularly in FIG. 5, associated with actuating assembly. When hooked tab 42 is engaged against stop member structure 44, which may comprise a recess in linking rod 46, linking rod 46 may not be moved in a forward direction to compress and actuate piezoelectric mechanism 34. Thus, latch member 36 prevents sufficient movement of trigger 38 toward valve actuator 30 so as to prevent the generation of a flame.

Piezoelectric mechanism 34 has been illustrated in FIGS. 1–3 schematically and particularly described in the '697 patent. The details necessary to an understanding of this invention have been shown in the drawings. In summary, however, piezoelectric mechanism 34 is a telescopic assembly which may be compressed to generate a voltage between first and second electrical contacts 48, 50.

Specifically, piezoelectric mechanism 34 contains a piezoelectric crystal in electrical contact with and generally situated between electrical contacts 48, 50. Electrical contact 48 is generally referred to as an anvil and electrical contact 50 contacts an impact pad positioned on an opposite side of the piezoelectric crystal. First electrical contact or anvil 48 is in direct contact with an electrically conductive shell 51, which is disposed on the outside of a portion of housing 12 at junction location 52, as best illustrated in FIG. 3.

Conductive shell 51 is preferably made out of metal, which may be disposed over a portion of housing 12. Second electrical contact 50 is connected to an insulated wire 54 having two exposed ends 56, 58. Exposed end 56 is connected to contact 50 while exposed end 58 is connected to nozzle 18. Nozzle 18 therefore acts as an electrode and is preferably formed of an electrically conductive metal such as brass or zinc for this purpose.

Conductive shell 51 electrically connects contact 48 at junction 52. At the opposite end, a tab 60 is stamped from shell 51 proximate end 20 to create a spark gap 62 with an outlet 64 of nozzle 18. Alternatively, an antenna may be associated with shell 51 to create the spark gap 62. An opening 66 at the end of conductive shell 51 allows the passage of a flame from the lighter. Also, in a conventional manner, side apertures 68, only one of which is shown in FIG. 1, may be provided to allow the intake of air.

In accordance with another aspect of this invention, an electrically insulating cap 70 is disposed around at least a portion of nozzle 18 and generally between nozzle 18 and conductive shell 51. This electrically insulating cap 70 helps to deter sparks from being generated between nozzle 18 and any surfaces of conductive shell 51 other than the tab 60.

In another embodiment, conduit 24 may be co-extruded with a conductive material along with a plastic material. For example, the plastic material may be extruded on the inside of conduit 24 to conduct fuel gas from fuel supply container 22 to nozzle 18, and a conductive material may be extruded to form the outside of conduit 24. Said conductive exterior would also have exposed ends 56 and 58, connected to contact 50 of piezoelectric element 34 and to nozzle 18, respectively. Alternatively, conduit 24 may be made out of a conductive material without the inner plastic material. Additionally, it may be desirable to coat, by co-extruding, an insulating layer outside of the conductive exterior to prevent electrical leakage from the conductive exterior to the surrounding.

Figure 6:
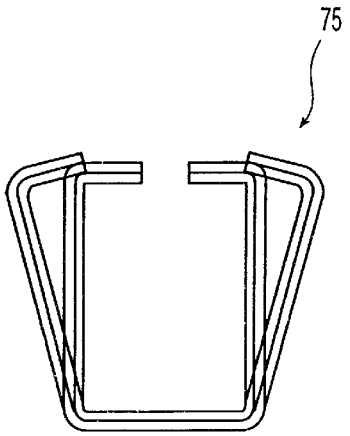
FIG. 6 is a front view of a ring member, also commonly referred to as a hanger, showing the ring member in the unassembled and assembled positions.

Handle 14 further includes recesses 72 on opposite sides thereof for receiving a ring member 75, having two opposite facing ends, as shown in FIG. 6, suitable for use in hanging lighter 10 during storage. Recesses 72 are preferably integrally formed during the molding process of handle 14 and may be formed either as blind holes, as shown, or through holes in handle 14. The opposite facing ends of ring member 75 are received in recesses 72, as ring 75 is bent inward. Ring 75 is configured and dimensioned to resiliently latch into groove 74 on end 16 of lighter 10, so that ring 75 is tucked away during use.

An internal upstanding surface 76, located at one end of handle 14 is ramped or inclined downwardly and toward second end 20 of housing 12, as shown in FIG. 1. During assembly of lighter 10 or replacement of fuel supply container 22, when container 22 is placed into handle 14 and pushed down, an end surface 22*a* of container 22 rides down ramped surface 76 until a lower locating edge 76*a* thereof abuts end surface 22a. Ramped surface 76 pushes fuel container 22 forward, and thereby pushes valve 28 of fuel supply container 22 into connector 26. In this position, valve 28 is securely connected with connector 26, and valve actuator 30 is in the proper position for actuation.

The operation of lighter 10 may be appreciated further from a review of FIGS. 2 and 3. In addition to trigger 38 and linking rod 46, actuating assembly 32 includes a biased pivoting member 80 operatively connected therebetween. Specifically, pivoting member 80 is mounted to a pin 82 in a biased manner, such as through a torsion spring (not shown) placed between member 80 and pin 82 such that member 80 is biased in a counterclockwise direction as viewed in FIGS. 1 and 3.

Alternatively, pivoting member 80 may be biased by a return spring disposed within the two telescopic members of piezoelectric mechanism 34 to maintain separation between the telescopic members. Said return spring exerts a biasing force on rod 46 which is in physical contact with pivoting member 80. Such a return spring is disclosed in the '697 patent.

In a further alternative, a compressive spring disposed under valve actuator 30 of fuel supply container 22 exerts a force on valve actuator 30 toward pivoting member 80. Said compressive spring may also bias member 80 in the same manner stated above. Such a compressive spring is disclosed in the '197 patent.

Biased pivoting member 80 further includes a pair of arms 84, 86 generally extending from pin 82. Arm 84 may include a knob 88 for depressing valve actuator 30 when the user pulls trigger 38. Alternatively, a portion of trigger 38 itself may be used to directly engage valve actuator 30. Trigger 38 preferably includes an extension 90 containing thereon a channel 92 for sliding movement relative to housing 12. Extension 90 further includes a slot 94 therewithin, which receives a pin 96 rigidly connected or molded with housing 12. In the position shown in FIG. 3, pin 96 acts as a stop against one end of slot 94 to prevent further forward movement of trigger 38. The opposite end of slot 94 may act as a stop in the other direction. Other types of features that limit forward or rearward movements can also be used.

Arm 86 of pivoting member 80 bears against one end of linking rod 46, as also shown in FIG. 3. Linking rod 46 is supported for sliding movement in forward and rearward directions by suitable support members, such as support members 98 molded into housing 12. Further support members are provided within housing 12 for various purposes, such as support members 100, 102 for holding ignitor assembly or piezoelectric mechanism 34 and support members 104, 106 (also shown in FIG. 4) for respectively holding fuel conduit 24 and connector 26.

Figure 4:
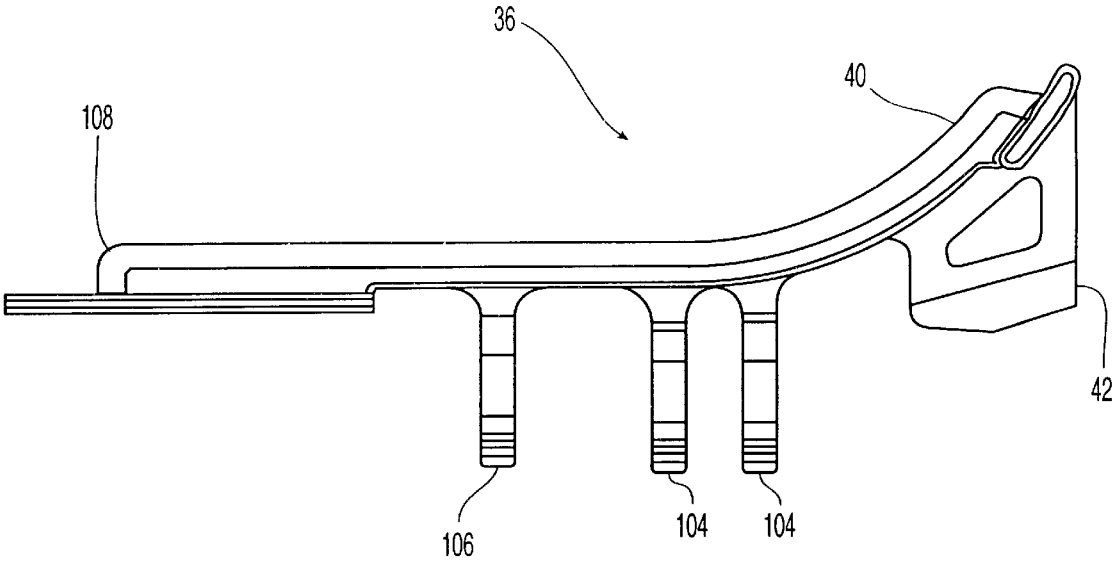
FIG. 4 is a front view of a latch member.
Figure 5:
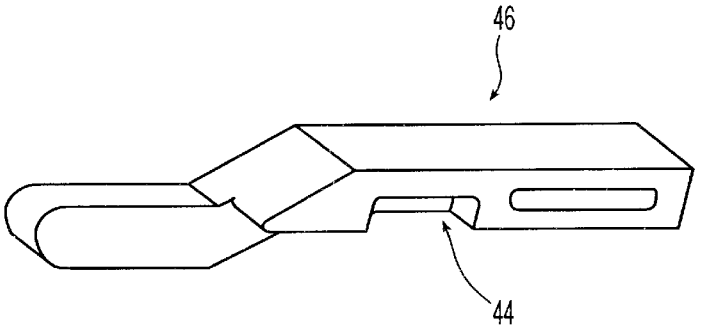
FIG. 5 is a perspective view of a linking rod.

FIGS. 2 and 4 best illustrate the construction and connection of latch member 36 to housing 12. Although other constructions may also be used incorporating other types of resilient members or springs, one design of the construction is a resilient member fixed with a cantilevered connection at one end 108 to handle 14. Specifically, a flange portion 110 fixed to end 108 of latch member 36 is contained within a slot 112 in handle 14. Front end 40 of latch member 36 remains unconnected to housing 12 and may be resiliently depressed downwardly to disengage hooked tab 42 from recess or stop member structure 44 of linking rod 46. It has been found that latch member 36 may be formed of a polymer that exhibits resiliency or flexure during operation. One such polymer for example is polyacetal.

The operation of lighter 10 will now be described generally with reference to FIG. 1. With one hand, a user grasps handle 14 with the index finger on trigger 38 and the thumb on front end 40 of latch member 36. Depressing and holding down the front end 40 of latch member 36 downwardly disengages hooked tab 42 from linking rod 46 (FIG. 3) and allows full movement of trigger 38. Thereafter, the user can pull trigger 38, which depresses valve actuator 30 thereby releasing fuel from fuel supply container 22 through valve 28, connector 26 and conduit 24. Gaseous fuel, such as butane, is thereby released from nozzle 18 at outlet 64. At the same time, the actuation of trigger 38 rotates arm 86 of spring biased pivot 80 in a clockwise direction against linking rod 46, as will be best understood from FIG. 3. Linking rod 46 moves forward and compresses piezoelectric mechanism 34 to generate a voltage between electrical contacts 48, 50. Electrical current passes from contact 48 into electrically conductive shell 51 and from contact 50 into wire 54, which is connected to electrically conductive nozzle 18. A spark is thereby generated in spark gap 62 to ignite the air/gas mixture in the vicinity of nozzle outlet 64. The resulting flame therefore passes through hole 66. As long as the user depresses front end 40 of latch member 36, the trigger may be repeatedly pulled and the piezoelectric mechanism 34 may be actuated repeatedly to generate a spark to ignite the released fuel in the event that the first actuation does not produce a flame.

When the user releases pressure from trigger 38, spring biased pivot 80 is biased in a counterclockwise position to disengage valve actuator 30, which is also biased in an outward direction, in order to close valve 28 and shut off the supply of fuel to nozzle 18. This extinguishes the flame emitted from hole 66. When the user releases thumb pressure from front end 40 of latch member 36, hooked tab 42 reengages recess or stop member structure 44 on linking rod 46 thus preventing movement of linking rod 46 with respect to ignitor assembly 34 and preventing or limiting inward movement of trigger 38. Therefore, as front end 40 of latch member 36 is normally biased in this upward position such that hooked tab 42 engages link member 46, a user cannot inadvertently leave lighter 10 in a state in which trigger 38 may simply be pulled to activate the lighter without again depressing latch member 36. Also, the relative difficulty of operating both the latch member and the trigger essentially at the same time further increases the skills required to operate the lighter.

Turning to FIGS. 7–12, another aspect of the present invention includes a linking mechanism, which is provided to ensure that fuel is present at the nozzle outlet 64 when the spark is created across the spark gap 62. Fuel travels through conduit 24 at a speed which is determined based upon such factors as fuel pressure, the size of conduit 24, and the flow rate of valve 28, among other factors. Thus, it is desirable to consider such factors in designing a linking mechanism which helps to ensure that the fuel reaches the nozzle outlet 64 prior to spark generation. The linking mechanism is preferably disposed between the actuating assembly and the valve actuator. When the actuating assembly is moved or depressed inwardly, it acts on the linking mechanism. The linking mechanism, being directly associated with the valve actuator, depresses the valve to release fuel.

Figure 7:
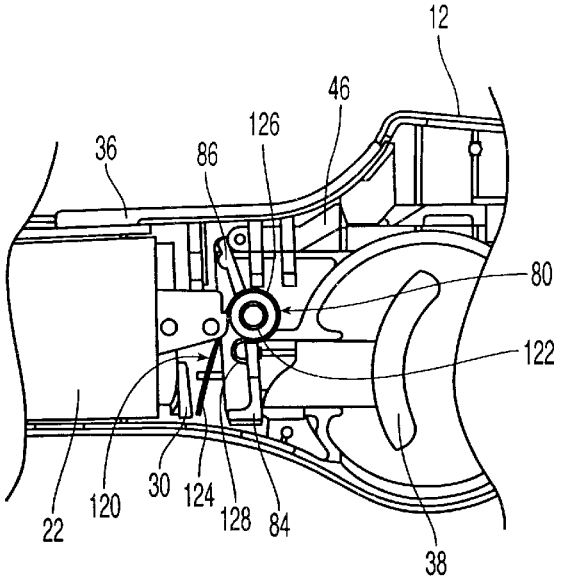
FIG. 7. is an enlarged and partially fragmented side elevational view similar to FIG. 1 depicting the linking mechanism of invention positioned is association with the actuating assembly.
Figure 8:
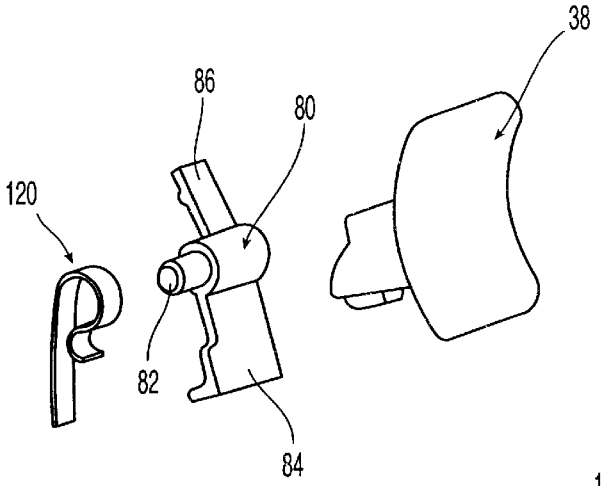
FIG. 8 is an extended perspective view of the trigger, biased pivoting member, and linking mechanism shown in FIG. 7.
Figure 9:
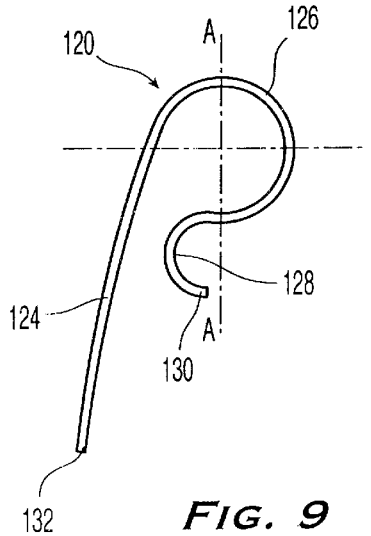
FIG. 9 is a side elevational view of the linking mechanism shown in FIG. 7.

A preferred embodiment of the linking mechanism of the present invention is shown in FIGS. 7–9 in the form of leaf spring 120. Leaf spring 120 is preferably disposed around and is cantilevered downwardly from a central portion 122 of the biased pivoting member 80. A proximal end 124 of spring 120 is preferably positioned adjacent valve actuator 30 and is designed to engage and depress valve actuator 30. A central part 126 of spring 120 is wrapped around the central portion 122 of the biased pivoting member in order to form an inverted U-shape and is preferably in close association with central portion 122.

A distal end 128 of leaf spring 120 extends downwardly from central portion 122 on a side of the central portion 122 opposite the proximal end 124. The distal end 128 is preferably bent outwardly in a C-shape so that a tip 130 of the distal end 128 abuts arm 84 of the biased pivoting member 80 to hold the spring 120 in non-rotating position on the biased pivoting member 80. As shown in FIG. 9, in order to accommodate the width of arm 84, tip 84 is preferably spaced relative to central axis A—A. Small gap 129 may be provided between the proximal end 124 of spring 120 and valve actuator 30 in order to allow for manufacturing tolerances and to help ensure that fuel flows only when trigger 38 is purposefully moved toward first end 16. For instance, small gap 129 may be about 0.5 mm in width. Alternatively, the proximal end 124 of spring 120 may rest on valve actuator 30. However, fuel should only be released when valve actuator 30 is depressed by the user. Spring 120 should not act to release fuel from the fuel supply 22 without movement of trigger 38.

It should be noted that the term distal, as used herein, refers to that portion which is closest to second end 20 of lighter 10. The term proximal is used herein to refer to that portion which is closest to first end 16.

In operation, trigger 38 is moved or depressed toward the first end 16 of housing 12, which results in a clockwise rotation of biased pivoting member 80. As biased pivoting member 80 rotates in this fashion about pin 82, the proximal end 124 of spring 120 rotates in a clockwise direction in concert with the rotation of the biased pivoting member 80. This rotation moves the tip 132 into engagement with valve actuator 30 resulting in depression of valve actuator 30 and the release of fuel from fuel container 22. Thus, fuel begins to be released substantially immediately after the trigger is depressed. With further depression of the trigger, equal to or less than the distance between the trigger and the valve actuator, the piezoelectric mechanism 34 is activated to generate a spark across spark gap 62. By activating the fuel supply prior to ignition of the spark, the fuel has time to travel through the conduit 24 to reach nozzle outlet 64 prior to or simultaneous with the creation of a spark at the nozzle. When trigger 38 is released, the biased pivoting member 80 is biased, with spring 120, in the counter-clockwise direction and spring 120 disengages from valve actuator 30 to allow the fuel supply valve 28 to close.

Spring 120 is preferably sufficiently stiff to allow the valve actuator 30 to be depressed by the proximal end 124 of spring 120 when trigger 38 moves arm 84 toward the first end 16 of housing 12. At the same time, spring 120 is preferably sufficiently resilient to allow trigger 38 to travel across the gap between the trigger 38 and the valve actuator 30 in order to allow the ignitor to ignite a spark. This gap between the trigger 38 and valve actuator 30 generally equates with the range of motion necessary to ignite the piezoelectric mechanism 34.

Spring 120 may be manufactured from a metal having resilient properties, such as spring steel, or from other types of materials. In addition, a tip 132 of proximal end 124 may be bent inwardly at a radius to ensure substantial alignment with the surface of the valve actuator 30 to more efficiently depress the valve actuator.

It should be noted that, while spring 120 is shown attached to biased pivoting member 80, it may alternatively be attached to trigger 38, valve actuator 30, another part of housing 12 in proximity to valve actuator 30, or any combination of these parts, as long as the spring 120 acts to depress the valve actuator 30 when the trigger 38 is moved toward the first end 16. This is equally true for all other linking mechanism embodiments disclosed herein.

Figure 10:
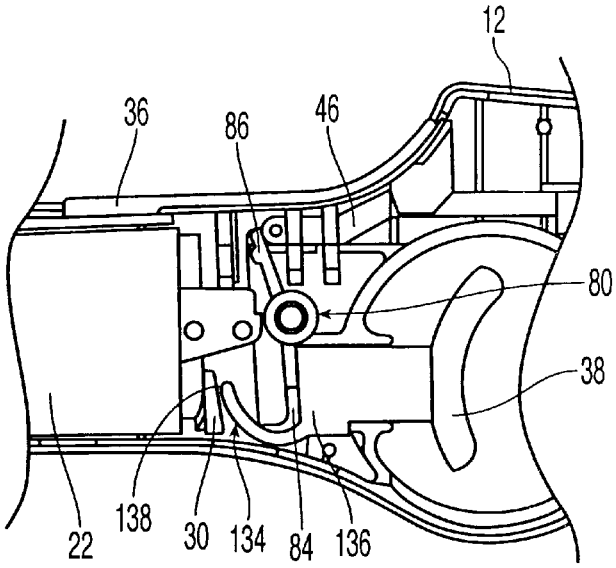
FIG. 10 is a partially fragmented side elevational view similar to FIG. 7 but depicting another alternative embodiment of the linking mechanism of the present invention.
Figure 11:
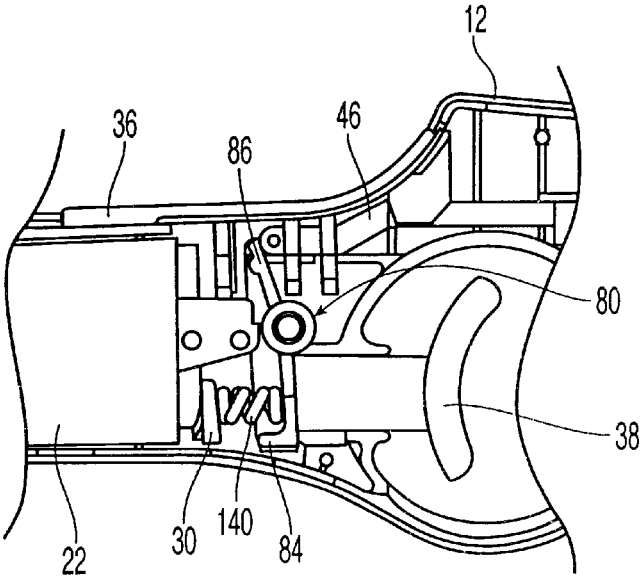
FIG. 11 is a partially fragmented side elevational view similar to FIG. 7 but depicting another alternative embodiment of the linking mechanism of the present invention.
Figure 12:
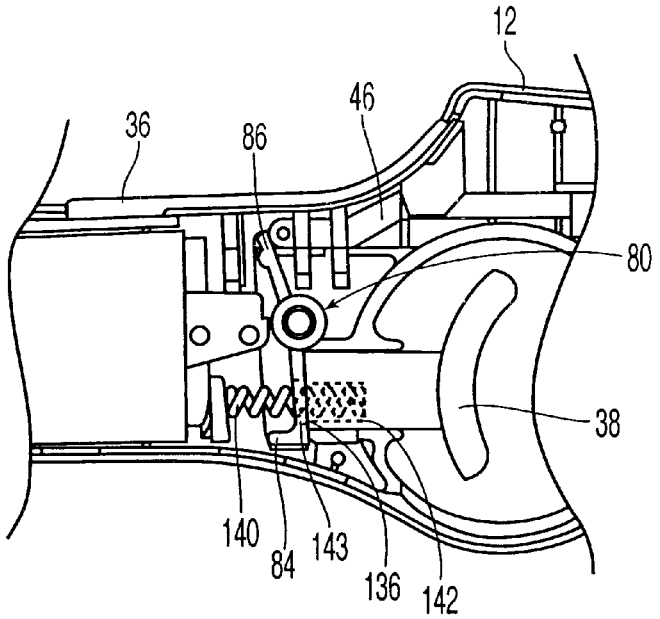
FIG. 12 is a partially fragmented side elevational view similar to FIG. 7 but depicting another alternative embodiment of the linking mechanism of the present invention.

Alternative embodiments of the linking mechanism are depicted in FIGS. 10–12. FIG. 10 shows an alternative leaf-type spring or flapper 134 which is preferably attached to trigger 38. Leaf spring 134 extends from a proximal end 136 of trigger 38 and has a free end 138 which is positioned adjacent valve actuator 30. Leaf spring 134 is preferably sufficiently stiff to allow trigger 38 to substantially immediately depress the valve actuator when trigger 38 is depressed. Leaf spring 134 is also preferably sufficiently resilient to deform to allow the trigger to move across at least a portion of the gap between the trigger and the valve actuator in order to activate the ignitor. The leaf spring shown is preferably molded integrally with the trigger such that both the trigger and the leaf spring are made of the same material, such as plastic, metal or the like.

Leaf spring 134, as depicted in FIG. 10, is formed with an inwardly curved shape to allow leaf spring 134 to more easily bend when the trigger 38 is depressed. As discussed above for spring 120, leaf spring 134 allows the valve actuator 30 to be substantially immediately depressed so that fuel begins to flow through conduit 24 before a spark is generated by the ignitor assembly 34. The spark is preferably created at the same time as or after that the fuel reaches nozzle outlet 64.

While spring 134, as shown in FIG. 10, is preferably integrally formed with trigger 38, it also may be independently formed and joined to the trigger by any conventional means. Furthermore, leaf spring 134 is not required to be the same material as trigger 38. In addition, leaf spring 134 may, alternatively, be attached to the biased pivoting member 80, such as on arm 84, or may be attached to valve actuator 30. If leaf spring 134 is attached to the valve actuator 30, the free end 138 of leaf spring 134 will preferably be positioned adjacent arm 84 or the distal end 136 of trigger 38. Further, small gap 129 may be utilized between free end 138 and valve actuator 30 to, for example, account for manufacturing tolerances.

The linking mechanism depicted in FIGS. 11 and 12 utilizes a compression-type spring 140 which is positioned between the valve actuator 30 and the biased pivoting member 80 (FIG. 11) or trigger 38 (FIG. 12). Compression spring 140 may be positioned between the valve actuator 30 and the biased pivoting member 80 or the trigger 38 such that the ends are free. A biasing force on compression spring 140 holds the spring in proper position. Alternatively, one or both ends may be fixed to their adjoining part or positioned in a recess or groove 142 so as to hold compression spring 140 in proper position. For instance, as depicted in FIG. 12, compression spring 140 is positioned in a groove 142 defined in the proximal end 136 of trigger 38. In addition, as shown in FIG. 12, a slot 143 may be provided through arm 84 in order to allow compression spring 140 to extend through arm 84 to engage groove 142 in trigger 38.

Compression spring 140 is preferably sufficiently stiff to allow trigger 38 and/or biased pivoting member 80 to substantially immediately depress the valve actuator when the trigger 38 is depressed. The compression spring 140 is also preferably sufficiently resilient to deform and allow trigger 38 to move across at least a portion of the gap between the trigger 38 (and biased pivoting member 80) and the valve actuator 30 in order to activate the ignitor 34. If compression spring 140 is in engagement with valve actuator 30 when trigger 38 has not yet been activated, compression spring 140 should be designed such that an initial small amount of compression is not sufficient to release fuel. Alternatively, a small gap 129, such as that depicted in FIGS. 7 and 12, may be positioned between the valve actuator 30 and the proximal end of compression spring 140.

The leaf and compression springs 134, 140 depicted in FIGS. 10–12 operate in substantially the same way as spring 120 depicted in FIG. 7. When an end of any of these springs is directly associated with the trigger 38, the valve actuator 30 is moved when the trigger 38 is moved. When an end of any of these springs is directly associated with the biased pivoting member 80, valve actuator 30 is moved when the biased pivoting member 80 is moved by trigger 38. In each embodiment, the valve actuator 30 is depressed to release fuel from the fuel container 22 to allow the fuel to travel to the nozzle 18 and, subsequently, the ignitor assembly 34 is activated to ignite a spark near the nozzle outlet 64, thereby causing the ignition of a flame.

Figure 13:
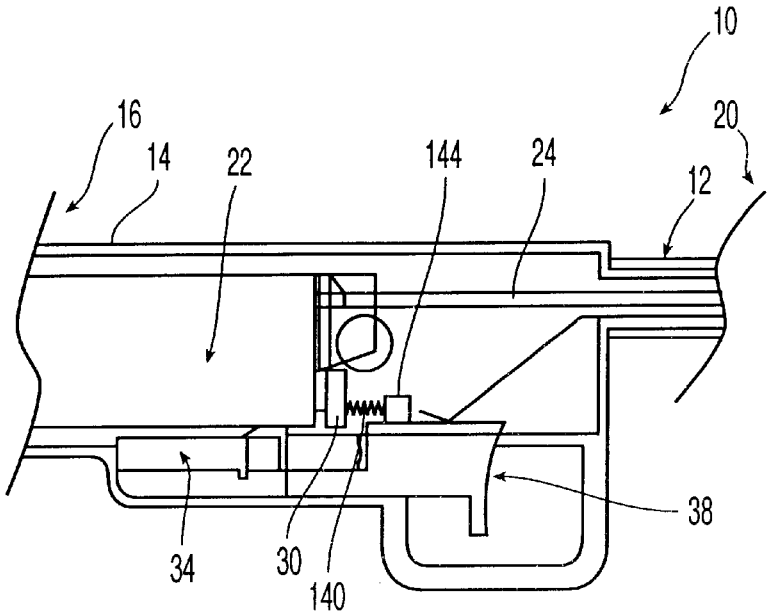
FIG. 13 is a partially fragmented side elevational view of an alternative embodiment of the a lighter incorporating the linking mechanism of the present invention with the lighter opened up to show various inner elements thereof.

Yet another alternative embodiment of the linking mechanism of the present invention is depicted in FIG. 13 for a differently configured lighter 10. A utility lighter 10 having a piezoelectric ignitor mechanism 34 is depicted with the trigger 38 aligned longitudinally with the piezoelectric unit 34. In this embodiment, when trigger 38 is moved toward first end 16 of lighter 10, trigger 38 directly acts on the piezoelectric unit 34. The linking mechanism is associated with the trigger 38, similar to the embodiments discussed above. As shown, the trigger 38 includes an appendage 144 positioned on top of trigger 38 in alignment with valve actuator 30. A compression spring 140 is positioned between the appendage 144 and the valve actuator 30. The compression spring operates in the same manner as discussed for FIGS. 11 and 12 above. Thus, the linking mechanism of the present invention can be applied to alternatively configured utility lighters, such as that shown in FIG. 13. It is understood that appropriate electrical connections and contacts may be provided, as discussed above, or in any conventionally known manner, in order to obtain a spark at the nozzle outlet 64 for the embodiment depicted in FIG. 13.

Furthermore, while a compression spring 140 is shown in use with the lighter of FIG. 13, it should be understood that any other type of linking mechanism contemplated by the present invention may be utilized. In addition, while a variety of types of springs are shown, it should be understood that other types of springs and/or resilient members may be utilized for the purpose of depressing the valve actuator 30. It is contemplated, for example, that two types of resilient members, having differing resilient properties, for example, may be utilized together, rather than the single member embodiments disclosed herein. In addition, a variety of types of fuel container configurations are contemplated for use with the linking mechanism concept disclosed herein, including those where the fuel nozzle is normally biased open and those where the fuel nozzle is normally biased closed.

Another aspect of the present invention is shown in FIGS. 14–20. As discussed above for FIG. 1, ramped surface 76 is provided to assist in positioning the fuel container 22 within handle 14. Ramped surface 76 helps to locate the container 22 based upon the bottom 22*a* of the container 22. Thus, a locating mechanism embodiment shown in FIG. 1 locates the fuel container at a point which is spaced relative to the valve 28 of the fuel container 22.

Alternatively, is it desirable to define a locating mechanism which assists in locating the fuel container 22 at a point which is in closer proximity to valve 28. Manufacturing tolerances and variations play a part in the location of the fuel container 22 within handle 14. Other factors also influence the location of the fuel container 22. Precise positioning and alignment serve to enhance the overall function of the lighter 10.

Importantly, the fuel container 22 should be positioned within handle 14 such that the valve 28 is at all times in association with valve connector 26 in order to ensure proper operation of the lighter 10. Valve 28 may either be connected to or positioned adjacent valve connector 26. When positioned adjacent valve connector 26, valve 28 is preferably aligned with the opening of valve connector 26. Thus, it is desirable to define a locating mechanism which is in close proximity to the valve 28 in order to more precisely position fuel container 22. By defining a locating point or datum near valve 28, the lighter is more consistently and reliably positioned in handle 14 for proper operation. Furthermore, locating mechanisms can be designed which help to hold the fuel container 22 in position in handle 14 such that both forward and backward movement of fuel container 22 are prevented.

FIGS. 14–20 depict a locating mechanism which is incorporated in the handle 14 of lighter 10 to positively position the fuel container 22 at a point which is substantially transversely aligned with valve 28 and valve connector 26.

Figure 14:
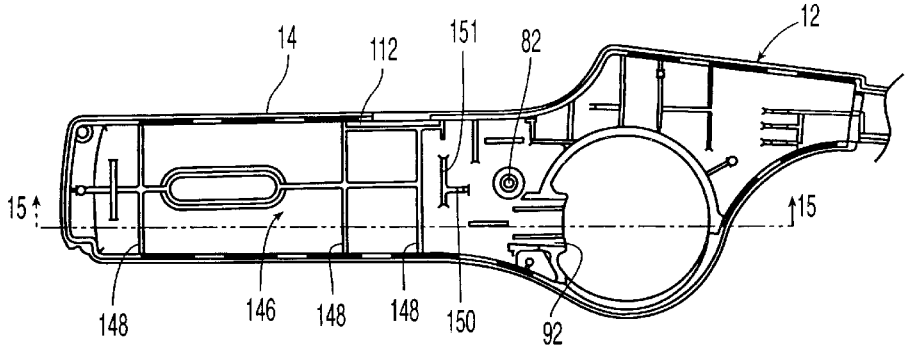
FIG. 14 is a partial internal side elevational view of the left side of the housing of the present invention depicting an embodiment of the locating mechanism.
Figure 15:
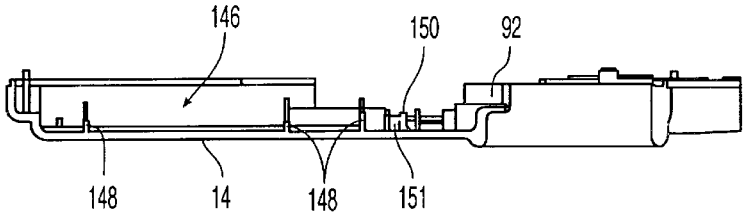
FIG. 15 is a cross-sectional view of the housing depicted in FIG. 14 taken at line 15—15.

A left body view of the interior of handle 14 is shown in FIGS. 14 and 15. Fuel container 22 is preferably positioned within recess 146, defined within the interior of handle 14. Handle 14 preferably includes supports 148 used to support the body of the fuel container 22. In addition, the interior surface of handle 14 preferably includes a locating mechanism in the form of a protruding tab 150. Protruding tab 150 is shown positioned on a T-shaped support 151 and extends above the upper surface of the T-shaped support 151. This T-shaped support 151 may also be used to support the body of fuel container 22. Protruding tab 150 is preferably positioned at a location which is in substantial transverse alignment with valve 28 and/or valve connector 26 when the fuel container 22 is seated in the handle 14.

Figure 18:
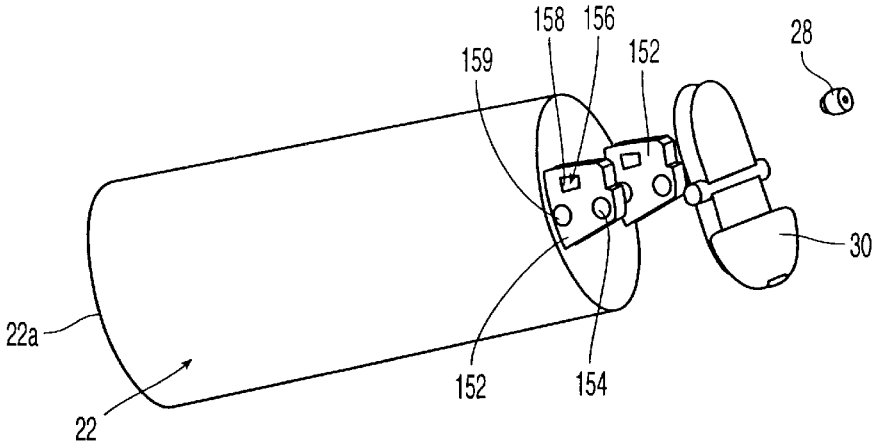
FIG. 18 is an extended view of a fuel container of the present invention incorporating several recesses for use with the locating mechanism.
Figure 19:
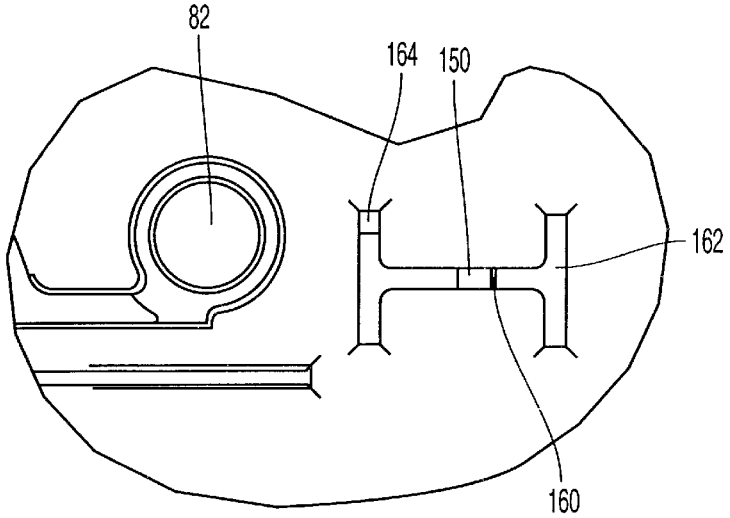
FIG. 19 is an enlarged view of the interior of the right side housing of the present invention shown in FIG. 16 taken at section 19—19.
Figure 20:
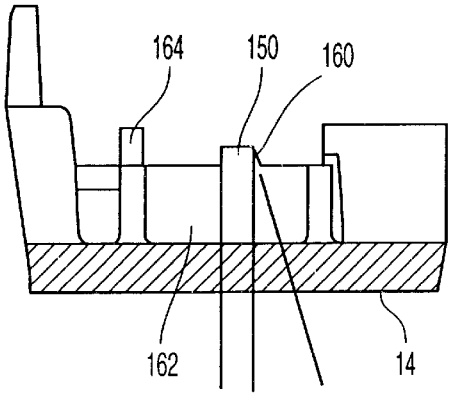
FIG. 20 is an enlarged view of the cross-section of the right side housing similar to that shown in FIG. 17 taken at section 20—20.

Protruding tab 150 preferably seats in a corresponding recess defined on a portion of the body of the fuel container 22. As shown in FIG. 18, fuel container 22 preferably includes extensions 152 at the top end thereof which assist in supporting the valve actuator 30. Extensions 152 preferably include a hole or recess 154 which is defined to engage the protruding tab 150 on handle 14. The hole or recess 154 may be formed during the formation or molding of the fuel container 22 and may be blind holes or through holes. The recess 154 may, alternatively, be shaped similarly to the protruding tab, such as shown for recess 156, which includes a ramped portion 158 for meeting with the inclined portion 160 of protruding tab 150. The pivot hole 159 for the valve actuator may also be used to engage the tab 150. Thus, a locating mechanism is provided wherein a protruding tab 150 engages a recess 154, 156 defined on the fuel container 22 to positively position the fuel container 22 at a point proximate the valve 28 and valve connector 26.

This locating mechanism helps to ensure a reliable and consistent association between valve 28 and valve connector 26.

Figure 16:
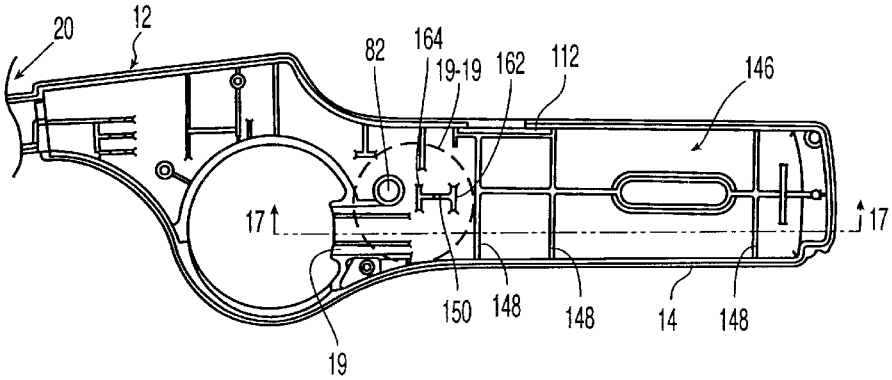
FIG. 16 is a partial internal side elevational view of the right side of the housing of the present invention depicting an embodiment of the locating mechanism.
Figure 17:
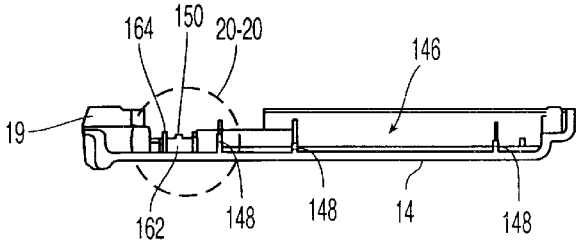
FIG. 17 is a cross-sectional view of the housing depicted in FIG. 16 taken at line 17—17.

An alternative embodiment of the locating mechanism is shown in the right body interior handle view of FIGS. 16 and 17. Fuel container 22 is preferably positioned within recess 146 and supports 148 are provided to support fuel container 22 within the interior of handle 14. A protruding tab 150 is positioned on an H-shaped support member 162 and extends above the top surface of member 162. Post 164 also extends from and above the top surface of member 162. Post 164 and protruding tab 150 may be inserted in recesses defined on the body of the fuel container 22, such as recess 154 and recess 156, respectively. Alternatively, post 164 may be utilized to limit movement of the fuel container toward the second end 20 of lighter 10 in conjunction with recess 154 or recess 156, which engage protruding tab 150.

It will be understood that any number of posts, protrusions, steps or similar locating members may be defined in the housing and/or on the fuel container 22 in order to locate the fuel container 22 within the handle 14 at a point proximate the valve 28 and/or valve connector 26. These posts, protrusions, steps, and similar locating members may also be used to prevent forward and backward movement of the fuel container 22 within housing 12. In an alternative embodiment, the fuel container 22 could include a post and the housing could include a recess. Moreover, the ramped surface 76 may be used in conjunction with the abovedescribed posts and tabs in order to assist in limiting movement toward the first end 16 of handle 14.

Figure 21:
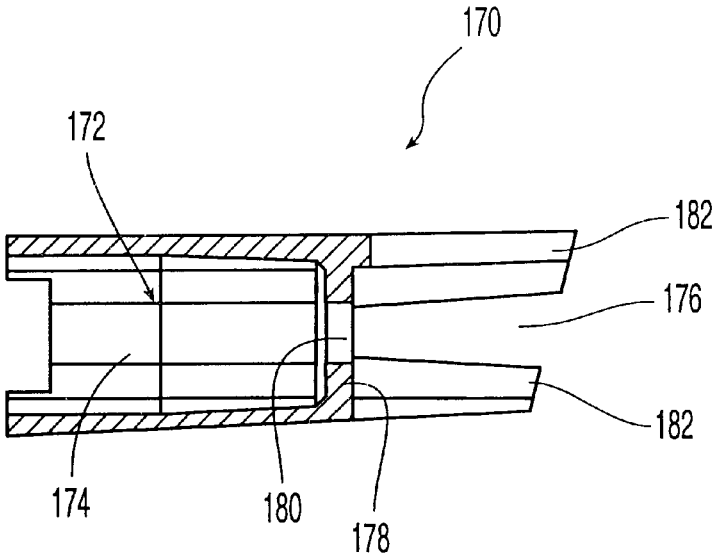
FIG. 21 is a partial cross-sectional side view of the isolator cap of the present invention.
Figure 22:
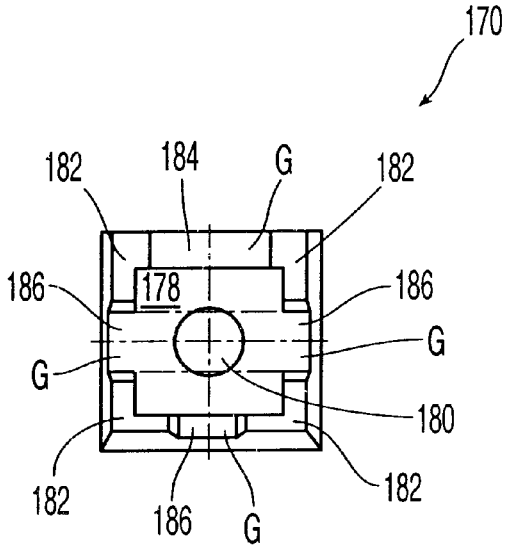
FIG. 22 is a right end view of the isolator cap shown in FIG. 21.

Another aspect of the present invention is depicted in FIGS. 21 and 22, which show an isolator cap 170. Isolator cap 170 is preferably non-conductive and is preferably positioned within metal shell 51, shown in FIG. 1. Isolator cap 170 assists in directing the electrically generated spark between the metal shell 51 and nozzle 18 to more efficiently and reliably cause the spark to ignite the fuel exiting from the nozzle outlet 64.

Isolator cap 170 includes a longitudinally extending channel 172 having a first portion 174 for receiving the fuel conduit 24 and a second portion 176 for surrounding a portion of nozzle 18. A wall 178 having a central aperture 180, which forms part of channel 172, is defined between the first 174 and second 176 portions. Nozzle 18 preferably is retained within central aperture 180. Isolator cap 170 is preferably used instead of insulating cap 70, discussed above for FIG. 1, but may be used in addition thereto. A plurality of legs 182 preferably extend from the wall 178 to surround second portion 176 and nozzle 18, which is preferably positioned to extend within second portion 176. A plurality of gaps G are defined between each of legs 182. Preferably, tab or antenna 60 extends inwardly between two of the legs into any one of gaps G, such as larger gap 184, so that the spark is directed through gap 184 between tab 60 and nozzle 18 to reliably ignite the fuel. Isolator cap 170, much like insulating cap 70, assists in avoiding stray spark generation in locations other than at the nozzle outlet 64. The remaining gaps 186 are utilized to allow the intake of air. Isolator cap 170 is preferably manufactured from a non-conductive material, such as nylon or other types of plastic.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A utility lighter comprising:

a housing having a handle proximate a first end and a nozzle with an outlet proximate a second end, the housing further including a fuel supply connected for selective fluid communication with the nozzle;

a valve actuator associated with the fuel supply for selectively releasing fuel from the fuel supply;

an ignitor assembly operatively connected to the housing for generating a spark at the nozzle outlet;

an actuating assembly connected to the housing proximate the handle and associated with the valve actuator to dispense fuel from the fuel supply and to activate the ignitor assembly; and a linking member positioned between the actuating assembly and the valve actuator to provide controlled release of fuel from the fuel supply prior to the generation of a spark by the ignitor assembly.

2. The utility lighter of claim 1 which further comprises a latch member operatively connected with the handle and including a blocking portion connected for biased movement relative to the actuating assembly and normally biased into engagement with the actuating assembly to prevent operative movement thereof, wherein the user may selectively bias the blocking portion out of engagement with the actuating assembly to permit operation of the actuating assembly.

3. The utility lighter of claim 1, wherein the actuating assembly comprises a trigger extending from the handle and movable to activate the valve actuator and the ignitor assembly.

4. The utility lighter of claim 3, wherein the actuating assembly further comprises a biased pivoting member operatively associated with the trigger and the ignitor assembly for activating at least the ignitor assembly when the trigger is moved toward the first end of the housing.

5. The utility lighter of claim 4, wherein the linking member is positioned between the biased pivoting member and the valve actuator such that when the biased pivoting member is moved toward the first end of the housing by the trigger, the linking member substantially immediately operates on the valve actuator to release fuel from the fuel supply.

6. The utility lighter of claim 5, wherein the linking member is a spring having a distal end associated with the biased pivoting member and a proximal end associated with the valve actuator, wherein the biased pivoting member acts on the distal end of the spring to move the proximal end of the spring to activate the valve actuator when the biased pivoting member is moved toward the first end by the trigger.

7. The utility lighter of claim 6, wherein the proximal end of the spring is normally spaced relative to the valve actuator when the trigger is not activated.

8. The utility lighter of claim 6, wherein the proximal end of the spring is normally in contact with the valve actuator when the trigger is not activated.

9. The utility lighter of claim 6, wherein the spring is a leaf spring fixedly positioned at the distal end around a portion of the biased pivoting member for pivotal movement therewith and positioned adjacent the valve actuator at the proximal end for contact with the valve actuator, wherein when the biased pivoting member is moved toward the first end of the housing by the trigger, the proximal end of the leaf spring moves the valve actuator to selectively release fuel from the fuel supply.

10. The utility lighter of claim 6, wherein the spring is a compression spring in contact at the distal end with the biased pivoting member and positioned adjacent the valve actuator at the proximal end for contact with the valve actuator, wherein when the biased pivoting member is moved toward the first end of the housing by the trigger, the proximal end of the compression spring moves the valve actuator to selectively release fuel from the fuel supply.

11. The utility lighter of claim 4, wherein the linking member is positioned between the trigger and the valve actuator such that when the trigger is moved toward the first end of the housing, the linking member substantially immediately operates on the valve actuator to release fuel from the fuel supply.

12. The utility lighter of claim 11, wherein the linking member is a spring having a distal end associated with the trigger and a proximal end associated with the valve actuator, wherein movement of the trigger toward the first end of the housing acts on the distal end of the spring to move the proximal end of the spring to activate the valve actuator.

13. The utility lighter of claim 12, wherein the proximal end of the spring is normally spaced relative to the valve actuator when the trigger is not activated.

14. The utility lighter of claim 12, wherein the proximal end of the spring is normally in contact with the valve actuator when the trigger is not activated.

15. The utility lighter of claim 12, wherein the spring is a leaf spring integral with and extending from the trigger and positioned adjacent the valve actuator at the proximal end for contact therewith, wherein when the trigger is moved toward the first end of the housing, the proximal end of the leaf spring moves the valve actuator to selectively release fuel from the fuel supply.

16. The utility lighter of claim 12, wherein the spring is a compression spring in contact at the distal end with the trigger and positioned adjacent the valve actuator at the proximal end for contact therewith, wherein when the trigger is moved toward the first end of the housing, the proximal end of the compression spring moves the valve actuator to selectively release fuel from the fuel supply.

17. The utility lighter of claim 1, wherein:

the fuel supply comprises a container housed in the handle, a valve operatively connected to the container for dispensing fuel to the nozzle, and the valve actuator for opening and closing the valve; and the handle comprises locating means for positively locating a distal end of the container in the handle.

18. A utility lighter comprising:

a housing having a handle proximate a first end, a nozzle proximate a second end and an electrically conductive housing portion disposed generally between the first and second ends, the second end of the housing including first and second electrodes forming a spark gap proximate the nozzle, wherein the first electrode is formed by the electrically conductive housing portion;

a fuel supply connected for selective fluid communication with the nozzle;

a valve actuator associated with the fuel supply for selectively releasing fuel therefrom;

an electric ignitor assembly operatively connected to the housing for generating a spark in the spark gap, the electric ignitor assembly being operative to generate a voltage between first and second electrical contacts thereof, the first electrical contact being in contact with the electrically conductive housing portion and the second contact being electrically connected to the second electrode;

an actuating assembly connected to the housing proximate the handle and operative to activate the valve actuator and the electric ignitor assembly; and a linking member positioned between the actuating assembly and the valve actuator to provide controlled release of fuel from the fuel supply so that fuel reaches the nozzle at least substantially simultaneously with the creation of a spark by the electric ignitor assembly.

19. The utility lighter of claim 18, wherein the electric ignitor assembly is a piezoelectric mechanism.

20. The utility lighter of claim 19, wherein the nozzle forms the second electrode.

21. The utility lighter of claim 20, wherein the electrically conductive housing portion includes a tab extending toward the nozzle to define the spark gap between the nozzle and the tab.

22. The utility lighter of claim 18 which further comprises a non-electrically conductive isolator cap for directing the travel of sparks across the spark gap, said isolator cap being disposed around at least a portion of the nozzle.

23. A utility lighter comprising:

a housing having a handle proximate a first end, a nozzle proximate a second end and an electrically conductive housing portion disposed generally between the first and second ends, the second end of the housing including first and second electrodes forming a spark gap proximate the nozzle, wherein the first electrode is formed by the electrically conductive housing portion and the second electrode is formed by the nozzle;

a fuel supply connected for selective fluid communication with the nozzle;

a valve actuator associated with the fuel supply for selectively releasing fuel therefrom;

an electric ignitor assembly operatively connected to the housing for generating a spark in the spark gap, the electric ignitor assembly being operative to generate a voltage between first and second electrical contacts thereof, the first electrical contact being in contact with the electrically conductive housing portion and the second contact being electrically connected to the nozzle;

an actuating assembly connected to the housing proximate the handle and operative to activate the valve actuator and the electric ignitor assembly; and a non-electrically conductive isolator cap for directing the travel of sparks across the spark gap, said isolator cap being disposed around at least a portion of the nozzle.

24. The utility lighter of claim 23, wherein the isolator cap is disposed inside of said electrically conductive housing portion.

25. The utility lighter of claim 24, wherein the isolator cap includes a longitudinal channel extending therethrough, with the nozzle being positioned within the channel, and a plurality of legs extending distally from a central portion of the isolator cap with a gap formed between each leg, the nozzle outlet being substantially centrally located between the plurality of legs.

26. The utility lighter of claim 25, wherein the isolator cap includes four legs and the electrically conductive housing portion includes a tab which extends toward the nozzle between two of the legs.

27. A utility lighter comprising:

a housing having a handle proximate a first end and a nozzle with an outlet proximate a second end, the housing further including a fuel supply container spaced from and connected for selective fluid communication with the nozzle, said container including a valve operatively connected to the container for dispensing fuel, and a valve actuator for opening and closing the valve to selectively release fuel from the fuel supply container, the valve being associated with a valve connector, which is positioned between the valve and the nozzle, when the container is properly positioned within the handle;

an ignitor assembly operatively connected to the housing for generating a spark at the nozzle outlet;

an actuating assembly connected to the housing proximate the handle and associated with the valve actuator to dispense fuel from the container and to activate the ignitor assembly; and locating means positioned on an inner surface of the handle for positively locating a distal end of the container at a point which is about transversely aligned with the valve connector.

28. The utility lighter of claim 27, wherein said locating means comprises at least one protrusion extending from the inner surface of the handle.

29. The utility lighter of claim 28, wherein the container includes at least one recess disposed on an exterior of the container at a distal end thereof and said at least one protrusion mates with said at least one recess to positively position the container within the handle.

30. The utility lighter of claim 27, wherein said locating means comprises at least one protrusion extending from an exterior of the container.

* * * * *